United States Patent [19]

Kondo et al.

[11] Patent Number: 4,488,081

[45] Date of Patent: Dec. 11, 1984

[54] IGNITION PLUG

[75] Inventors: Ryoji Kondo, Okazaki; Kanji Higuchi, Hekinan; Kozo Takamura, Nagoya; Yasuyuki Sato, Kasugai; Minoru Nagai, Kariya, all of Japan

[73] Assignee: Nippondenso Co., Ltd., Kariya, Japan

[21] Appl. No.: 427,820

[22] Filed: Sep. 29, 1982

[30] Foreign Application Priority Data

Oct. 1, 1981 [JP] Japan ..... 56-156840

[51] Int. Cl.[3] ..... H01T 13/20

[52] U.S. Cl. ..... 313/141; 313/142

[58] Field of Search ..... 313/141, 142, 136, 141.1

[56] References Cited

U.S. PATENT DOCUMENTS 1,160,911 11/1915 Latch ..... 313/142

2,296,033 9/1942 Heller ..... 313/141 X 2,391,456 12/1945 Hensel ..... 313/141 X 2,642,053 6/1953 Dowson ..... 313/141

2,955,222 10/1960 Beesch ..... 313/141

3,868,530 2/1975 Eaton et al. ..... 313/141

*Primary Examiner*—Palmer Demeo

*Attorney, Agent, or Firm*—Cushman, Darby & Cushman

[57] ABSTRACT

An ignition plug of extended durability which reduces crack formation in noble metal layer on the center electrode and the ground electrode by joining a noblemental layer consisting of 85 to 70% by weight of Pt and 15 to 30% by weight of Ir to the spark discharge portion of the center electrode and also another noble metal layer consisting of 90 to 70% by weight of Pt and 10 to 30% by weight of Ni to the spark discharge portion of the ground electrode.

1 Claim, 4 Drawing Figures

IGNITION PLUG

The present invention relates to an ignition plug to be used in internal combustion engines.

In conventional ignition plugs for internal combustion engines, noble metals such as Pt, Pd, etc. are joined to the spark discharge portion of the electrode.

Figure 1:
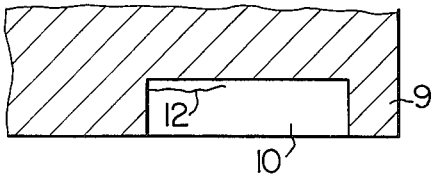
FIG. 1 is a schematic illustration showing the spark discharge portion of an ignition plug to be used for explaining the basic idea of the present invention.

The present inventors have found that, since electrodes of conventional ignition plugs are exposed to high temperature atmospheres in combustion chambers of internal combustion engines, for instance in the ground electrode, as shown in FIG. 1, a crosswise crack 12 appears in noble metal 10 along the axial direction of the ground electrode 9, and consequently the noble metal 10 is very likely to peel off.

With respect to the above problem, the present inventors made extensive studies and found the following facts. That is, since, for instance, the above ground electrode is composed of a metal using a nickel-containing metal as the base material, a difference in coefficient of thermal expansion appears between the noble metal 10 and the ground electrode 9, which causes a big heat stress at the interface of the two, and resultantly the above crack 12.

Meanwhile, when a noble metal layer is joined to the center electrode, since the temperature of the center electrode is lower by about 100° C. than that of the ground electrode even at full load operation of the internal combustion engine, cracking of this noble metal layer is less. Even in this case, it is desirable if the cracking tendency can be reduced further.

Hence, the object of the present invention is to provide an ignition plug of extended durability which reduces crack formation in noble metal layer on the center electrode and the ground electrode by joining a noble metal layer consisting of 85 to 70% by weight of Pt and 15 to 30% by weight of Ir to the spark discharge portion of the center electrode and also another noble metal layer consisting of 90 to 70% by weight of Pt and 10 to 30% by weight of Ni to the spark discharge portion of the ground electrode.

Figure 2:
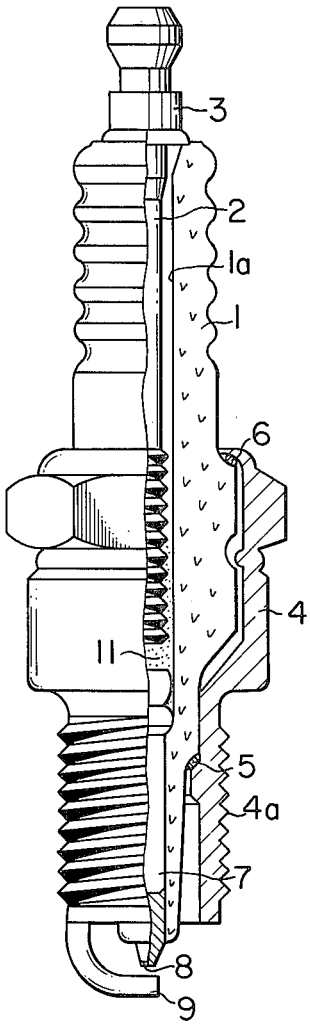
FIG. 2 is a half-cutway sectional view showing an example of the present invention.
Figure 3:
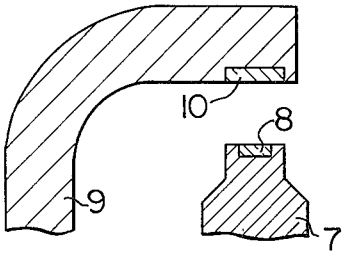
FIG. 3 is a key-part-enlarged sectional view of FIG. 2.

The present invention will be explained in more detail hereinunder, referring to the specific Examples. In FIGS. 2 and 3, 1 is an electrically insulating porcelain comprising an alumina porcelain and has an axial hole 1*a* in the center. 2 is a center shaft comprising a carbon steel and inserted in the upper part of the axial hole 1*a* of the electrically insulating porcelain 1. 3 is a terminal comprising brass, etc. and fixed to the top of the center shaft 2 by screwing in the shaft 2. 4 is a cylindrical housing and composed of a heat-resistant and electroconductive metal and fixed to the above mentioned electrically insulating porcelain 1 through a ring-shaped, air-tight packing 5 and a meshing ring 6, both 5 and 6 being located inside the housing 4. The housing 4 has a thread portion 4*a* for fixing the ignition plug to an engine block. 7 is a center electrode comprising a heat-resistant, corrosion-resistant, electro-conductive metal such as Ni-Cr based Inconel. The front end of the center electrode is conical and has a narrower diameter.

8 is a platinum disc plate according to the present invention and joined to the front end face of the center electrode 7 by a process such as resistance welding. This plate 8 is composed of 15 to 30% by weight of Ir and the remainder of Pt.

9 is a ground electrode comprising a heat-resistant corrosion-resistant, electro-conductive metal such as Ni-Cr based Inconel, and is joined to the end face of the above-mentioned housing 4. 10 is a platinum plate and joined to the ground electrode 9 by a process such as resistance welding in such a way that this plate 10 and the above-mentioned plate 8 face each other. The plate 10 is composed of 10 to 30% by weight of Ni and the remainder of Pt. 11 is an electroconductive glass seal layer confined in the axial hole 1*a* of the electrically insulating porcelain 1, and is composed of copper powder and low-melting glass. This seal layer 11 electrically connects the center shaft 2 and the center electrode 7 and fixes these two not to allow their movement in the axial hole 1*a* of the electrically insulating porcelain 1.

In the above structure, the operation of the ignition plug will be explained. The ignition plug according to the present invention has a function that the plug is placed in the engine combustion chamber and discharges sparks to ignite an air-fuel mixture gas, and aims at a reduction in consumption of the discharge portions of electrodes by joining platinum alloy plates to their discharge surfaces. Since these platinum alloy plates are expensive and need be used in quantities as small as possible, they are joined to respective base materials such as Ni-Cr alloy or Inconel. At this time, a problem will occur. That is, since differences in coefficient of thermal expansion (almost close to $5\times10^{-6}$/°C.) exist between platinum alloy plates and base materials and they are exposed to a condition in which high and low temperatures are repeated, crosswise cracks appear in platinum alloy plates, as represented in FIG. 1, due to fatigue by heat stress and finally these platinum alloy plates are detached. One method for combatting the above problem is to make plate diameters smaller to reduce heat stress. A more fundamental method is to make smaller differences in coefficient of thermal expansion between platinum alloy plates and electrodes.

Hence, in the present invention, it was planned that the above difference in coefficient of thermal expansion be lowered by adding, to the platinum alloy plate 10, nickel which is a major component of the base materials of the electrodes 7 and 9. Increase of a nickel quantity in the plate 10 lowers the difference in coefficient of thermal expansion and thereby crosswise cracks are less likely to appear. On the other hand, increase of nickel aggrevates spark consumption of the plate 10 and impairs the original purpose of the present ignition plug of high durability.

Figure 4:
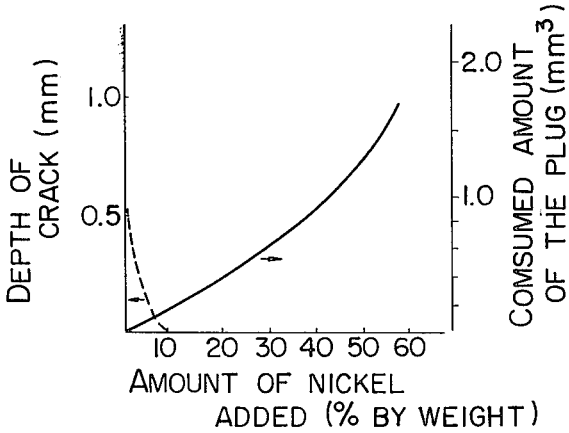
FIG. 4 is a characteristic curve used for showing an effect of the present invention.

Therefore, a relation among (a) quantity of nickel added, (b) depth of crack and (c) electrode volume decreased due to sparks was studied as shown in FIG. 4. In FIG. 4, the electrode volume decreased due to sparks was measured by using an ignition apparatus of 50 millijoules and adopting a condition of 12,000 sparks per minute, 4 atm (gauge), 200° C. and 100 hours (atmosphere).

The depth of crosswise crack is a distance from the end face to the crosswise crack which appears due to heat stress when a cycle consisting of 1 minute wide-open-throttle driving and 1 minute idling is repeated 50 times (100 minutes) and it is continued for 100 hours (6,000 minutes).

As obvious from FIG. 4, crosswise cracks do not appear when the quantity of nickel added is at least 10% by weight. Meanwhile, the quantity of electrode decreased due to sparks increases with the increase of the quantity of nickel added. Overall, addition of 10% by weight of nickel is an optimum condition. However, even if the quantity of nickel to be added is increased up to about 30% by weight, 60,000 miles proposal durability for ignition plugs can be satisfied. Accordingly, the quantity of nickel to be added is preferably 10% to 30% by weight.

Generally, the ratio of consumptions of the center electrode 7 and the ground electrode 9 is about 7:3 in ignition apparatus of one discharge type. Accordingly, it is useful to employ a platinum plate in the ground electrode 9 to which there is added nickel resistant to crosswise cracks but slightly weak for consumption. Also, it is useful from the point of preventing crosswise cracks due to heat stress to employ a nickel-added platinum plate 10 in the ground electrode 9 of which temperature is about 100° C. higher than that of the center electrode 7 at wide-open throttle.

The temperature of the center electrode 7 is lower than that of the ground electrode 9 and resulting cracks are less likely to appear in the platinum plate 8 of the center electrode 7 than in the platinum plate 10. Accordingly, a Pt-Ir alloy is desirable for the platinum plate 8 from the necessity of anti-consumption. This Pt-Ir alloy can almost completely eliminate cracks of the platinum plate 8 due to its composition.

Results of experiments are shown below.

Shown in Table 1 are levels of cracks when a hot-cold heat cycle of keeping at 850° C. for 6 minutes and when at room temperature for 6 minutes is repeated 200 times.

TABLE 1

| Material | Level of cracks |
|---|---|
| 100% Pt | x |
| 95% Pt—5% Rh | x |
| 90% Pt—10% Rh | x |
| 85% Pt—15% Rh | x |
| 80% Pt—20% Rh | Δ |
| 75% Pt—25% Rh | Δ |
| 70% Pt—30% Rh | Δ |
| 95% Pt—5% Ir | x |
| 90% Pt—10% Ir | Δ |
| 85% Pt—15% Ir | ○ |
| 80% Pt—20% Ir | ◎ |
| 75% Pt—25% Ir | ◎ |
| 70% Pt—30% Ir | ◎ |

Level of cracks =
x very deep
Δ deep
○ a slight number of cracks
◎ little cracks Another result similar to those of Table 1 was also obtained in a test with an actual engine (4-cycle, 4-cylinders, 1,600 cc piston displacement) in which electrode durability was examined at full throttle and 5,000 rpm for 100 hours. Thus, it was found that addition of Ir to the platinum plate of the center electrode 7 in a quantity of 15 to 30% by weight enhances durability remarkably.

The present invention is not restricted by the above-mentioned Examples and may be used in a variety of embodiments as described below.

(1) To the noble metal layers 8 and 10, there may be added Au, Rh, Pd, Ru and Os.

(2) The present invention can be applied to an ignition plug in which the axial side face of a center electrode and the front end of a ground electrode are facing each other.

(3) In Examples of FIGS. 2 and 3, the front end of the center electrode is conical and tapered. However, the front end may be simply cylindrical.

(4) Noble metal layers may be joined to electrodes also by laser welding, brazing, electron beam welding, etc.

(5) Materials of the center and ground electrodes may also be 15% Cr—8% Fe - Remainder Ni. In other words, those materials may be those using a nickel-containing metal as the base materials.

In summary, the present invention can reduce cracks of noble metal layers and accordingly can provide an ignition plug of extended durability. Also, the present invention can improve anti-consumption of noble metal layers.

What is claimed is:

1. An ignition plug in which (1) a Pt-Ir noble metal layer containing about 15 to 30% by weight of Ir and the remainder of Pt based on the total of Pt and Ir is joined to the spark discharge portion of a center electrode at least using a nickel-containing metal as a base metal, and (2) a Pt-Ni noble metal layer containing about 15 to 30% by weight of Ni and the remainder of Pt based on the total of Pt and Ni is joined to the spark discharge portion of a ground electrode at least using a nickel-containing metal as a base metal.

* * * * *